US008342436B2

(12) United States Patent
Sim et al.

(10) Patent No.: US 8,342,436 B2
(45) Date of Patent: Jan. 1, 2013

(54) PULVERIZING SCREW, PULVERIZING CASING AND PULVERIZER FOR FOOD WASTE TREATMENT APPARATUS HAVING THE SAME

(75) Inventors: Sang Gu Sim, Gyeonggi-do (KR); Dong Hun Lee, Seoul (KR); Sang Jun Jee, Incheon (KR)

(73) Assignee: Woongjin Coway Co., Ltd., Chungcheongnam-do (KR)

( * ) Notice: Subject to any disclaimer, the term of this patent is extended or adjusted under 35 U.S.C. 154(b) by 0 days.

(21) Appl. No.: 13/466,737

(22) Filed: May 8, 2012

(65) Prior Publication Data

US 2012/0217332 A1 Aug. 30, 2012

Related U.S. Application Data

(62) Division of application No. 12/459,301, filed on Jun. 29, 2009, now Pat. No. 8,191,811.

(30) Foreign Application Priority Data

Oct. 14, 2008 (KR) ..... 10-2008-0100874

(51) Int. Cl.
*B02C 19/22* (2006.01)

(52) U.S. Cl. ..... 241/260.1; 241/285.1

(58) Field of Classification Search ..... 241/260.1, 241/285.1

See application file for complete search history.

(56) References Cited

U.S. PATENT DOCUMENTS

| | | | | |
|---|---|---|---|---|
| 1,732,775 | A | 10/1929 | Shaver | |
| 4,983,046 | A * | 1/1991 | Murata et al. | 366/312 |
| 5,123,600 | A | 6/1992 | Takenaka | |
| 5,148,999 | A | 9/1992 | Curfman et al. | |
| 5,358,185 | A * | 10/1994 | Konecsny | 241/18 |

FOREIGN PATENT DOCUMENTS

| | | | |
|---|---|---|---|
| EP | 0 474 538 | A1 | 3/1992 |
| GB | 602 862 | A | 6/1948 |
| JP | 2000-317420 | A | 11/2000 |
| KR | 10-1993-0006962 | | 11/1994 |
| KR | 10-0498249 | | 10/2003 |

* cited by examiner

*Primary Examiner* — Mark Rosenbaum
(74) *Attorney, Agent, or Firm* — Edwards Wildman Palmer LLP; Peter F. Corless; Christine C. O'Day

(57) ABSTRACT

The present invention provides a pulverizing screw, a pulverizing casing and a pulverizer having the same. The pulverizing screw includes a rotating shaft and a drive blade which extends from the rotating shaft in a spiral shape. The drive blade rotates in the pulverizing casing in such a manner as to maintain a predetermined distance between the drive blade and the inner surface of the pulverizing casing to prevent the drive blade from being impeded by the inner surface of the pulverizing casing. The drive blade extends from a first end of the rotating shaft in a spiral shape surrounding the rotating shaft in a clockwise or counterclockwise direction and is connected to a second end of the rotating shaft. The pulverizing casing comprises a spherical body having a space therein. The pulverizing screw is installed in the spherical body so as to be rotatable.

3 Claims, 8 Drawing Sheets

PULVERIZING SCREW, PULVERIZING CASING AND PULVERIZER FOR FOOD WASTE TREATMENT APPARATUS HAVING THE SAME

BACKGROUND OF THE INVENTION

1. Field of the Invention

The present invention relates generally to a pulverizer of a food waste treatment apparatus and, more particularly, to a pulverizing screw, a pulverizing casing and a pulverizer for a food waste treatment apparatus having the same in which the pulverizing screw has a spiral structure and the pulverizing casing has a spherical shape, and which are configured to more effectively agitate and pulverize input food waste.

2. Description of the Related Art

Generally, every house, restaurant, etc. discharges a predetermined amount of food waste everyday. Typically, such food waste is dumped after only water is removed from the food waste using a filter or the like. This conventional food waste treatment method increases the amount of food waste. If dumped food waste is not frequently treated, odors may result, with the result that the surrounding air is polluted.

To effectively reduce and recycle food waste, the development of a food waste treatment apparatus for home use which can solve the above problems is in demand. Generally, a food waste treatment apparatus which is coupled to the domestic sink of a kitchen counter removes water from food waste and reduces the volume of the food waste through a series of processes including dehydration, cutting and drying, thus reducing the amount of food waste discharged.

Food waste treatment apparatuses are classified into a variety of different kinds according to the method of treating food waste, and they are classified into a variety of different kinds according to the use thereof.

Furthermore, in conventional food waste treatment apparatuses, according to the orientation of a rotating shaft and the shape of a pulverizer, they may be classified into the vertical cylindrical type pulverizer and the horizontal cylindrical type pulverizer.

In the case of the vertical cylindrical type pulverizer, when treating food waste, a relatively low load is applied to a motor which operates a pulverizing screw to pulverize the food waste. Hence, a low-noise design can be realized. However, because the pulverizing screw is provided on the lower portion of the apparatus, food waste may not be evenly agitated or pulverized, with the result that a grain size of pulverized food waste is relatively large and food waste undesirably lumps at the central portion of the pulverizing screw and thus may not be pulverized. Furthermore, since a heater for drying food waste is provided in the lower portion of the apparatus, pulverizing and drying performance is reduced. On the other hand, the ratio of the volume occupied by the pulverizing screw is low, so that the amount of input food waste in relation to the overall size of the apparatus can be increased.

In the horizontal cylindrical type pulverizer, because a pulverizing screw for pulverizing food waste extends for the entire length of a pulverizer, food waste can be satisfactorily agitated and pulverized. Furthermore, a heater for drying food waste is provided along the cylindrical surface of the pulverizer, so that heat can be efficiently transferred to the food waste, thus increasing the efficiency of drying. However, pulverization of food waste is focused on both ends of the pulverizing screw (that is, on both ends of the pulverizer). In addition, a large quantity of food waste is compressed by the rotation of the pulverizing screw. Thereby, an overload is applied to the pulverizing screw, with the result that it may become stopped. Furthermore, there is a disadvantage in that the amount of food waste which can be input into the pulverizer is reduced because of the large volume ratio occupied by the pulverizing screw related to the volume of the pulverizer.

SUMMARY OF THE INVENTION

Accordingly, the present invention has been made keeping in mind the above problems occurring in the prior art, and an object of the present invention is to provide a pulverizing screw, a pulverizing casing and a pulverizer for a food waste treatment apparatus having the same which can effectively pulverize and agitate food waste which is input into the pulverizer.

In an aspect, the present invention provides a pulverizing screw of a food waste treatment apparatus having a pulverizing casing, the food waste treatment apparatus pulverizing, agitating and drying food waste input into the pulverizing casing, the pulverizing screw being provided in the pulverizing casing so as to be rotatable and including: a rotating shaft; and at least one drive blade extending from the rotating shaft in a spiral shape.

The drive blade rotates in the pulverizing casing in such a manner as to maintain a predetermined distance between the drive blade and an inner surface of the pulverizing casing to prevent the drive blade from being impeded by the inner surface of the pulverizing casing, and the drive blade extends from a circumferential outer surface of a first end of the rotating shaft in a spiral shape surrounding the rotating shaft in a clockwise or counterclockwise direction and is connected to a circumferential outer surface of a second end of the rotating shaft.

The drive blade may extend continuously from the outer surface of the first end of the rotating shaft to the outer surface of the second end thereof.

Furthermore, a space may be defined between the drive blade and the rotating shaft in a radial direction.

In addition, a medial portion of the drive blade may be farther from the rotating shaft than are other portions thereof.

The pulverizing screw may further include a support bar provided on a medial portion of the rotating shaft to support the pulverizing screw.

As well, a cutting piece may be provided on an outer cutting edge of the drive blade in the radial direction of the rotating shaft. The cutting piece may have a predetermined thickness.

In another aspect, the present invention provides a pulverizing casing of a food waste treatment apparatus having a pulverizing screw provided in the pulverizing casing so as to be rotatable, the food waste treatment apparatus pulverizing, agitating and drying food waste input into the pulverizing casing, wherein the pulverizing screw rotates in the pulverizing casing in such a manner as to maintain a predetermined distance between the pulverizing screw and an inner surface of the pulverizing casing to prevent the pulverizing screw from being impeded by the inner surface of the pulverizing casing, and the pulverizing casing comprises a spherical body having a hollow space therein.

One or more pulverizing ribs may protrude from a circumferential inner surface of the spherical body.

The pulverizing ribs may be spaced apart from each other, and each pulverizing rib may have depressions therein. An imaginary line connecting the depressions of the pulverizing ribs to each other may form an arc line on the circumferential inner surface of the spherical body in a direction which makes an angle with the pulverizing ribs.

Furthermore, a hollow cylindrical input port may extend from an upper portion of the spherical body. The input port may be parallel to a support surface.

In still another aspect, the present invention provides a pulverizer of a food waste treatment apparatus, including: a spherical body having a hollow space therein; and a pulverizing screw, having a rotating shaft installed in the spherical body so as to be rotatable, and at least one drive blade extending from the rotating shaft in a spiral shape.

The drive blade rotates in the spherical body in such a manner as to maintain a predetermined distance between the drive blade and an inner surface of the spherical body to prevent the drive blade from being impeded by the inner surface of the spherical body.

The drive blade may extend from a circumferential outer surface of a first end of the rotating shaft in a shape surrounding the rotating shaft in a clockwise or counterclockwise direction and be connected to a circumferential outer surface of a second end of the rotating shaft.

The drive blade may extend continuously from the outer surface of the first end of the rotating shaft to the outer surface of the second end thereof, and a medial portion of the drive blade may be farther from the rotating shaft than are other portions thereof.

Furthermore, a space may be defined between the drive blade and the rotating shaft in a radial direction.

As well, a cutting piece having a predetermined thickness may be provided on an outer cutting edge of the drive blade in the radial direction of the spherical body, so that when the drive blade rotates, food waste is pulverized by reciprocal action between the cutting piece and the inner surface of the spherical body.

One or more pulverizing ribs having predetermined lengths may protrude from a circumferential inner surface of the spherical body.

The pulverizing ribs may be spaced apart from each other, and each pulverizing rib may have depressions therein. An imaginary line connecting the depressions of the pulverizing ribs to each other may form an arc line on the circumferential inner surface of the spherical body in a direction making an angle with respect to the pulverizing ribs.

The cutting piece may be movable on the circumferential inner surface of the spherical body along the imaginary line connecting the depressions of the pulverizing ribs.

Furthermore, a hollow cylindrical input port may extend from an upper portion of the spherical body. The input port may be parallel to a support surface.

In addition, an outlet may be formed in a lower end of a central portion of the spherical body. The outlet may be closed so as to be openable to discharge food waste from the spherical body.

The outlet may be openably closed by a valve door.

As well, a circumferential bent portion may be formed by a junction between the input port and the upper portion of the spherical body. The outer cutting edge of the drive blade may pass over the circumferential bent portion in such a manner as to maintain a predetermined distance therebetween to cut the food waste.

Moreover, a cutting notch having a predetermined depth may be formed in an outer cutting edge of the drive blade in a radial direction of the spherical body, and a pulverizing protrusion may be provided on the inner surface of the spherical body, so that when the drive blade rotates, food waste is pulverized by reciprocal action between the cutting notch and the pulverizing protrusion.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a pulverizing screw, a pulverizing casing and a pulverizer for food waste treatment apparatuses having the same according to preferred embodiments of the present invention will be described in detail with reference to the attached drawings.

A first embodiment of the present invention will be described in detail with reference to the related drawings.

Figure 1:
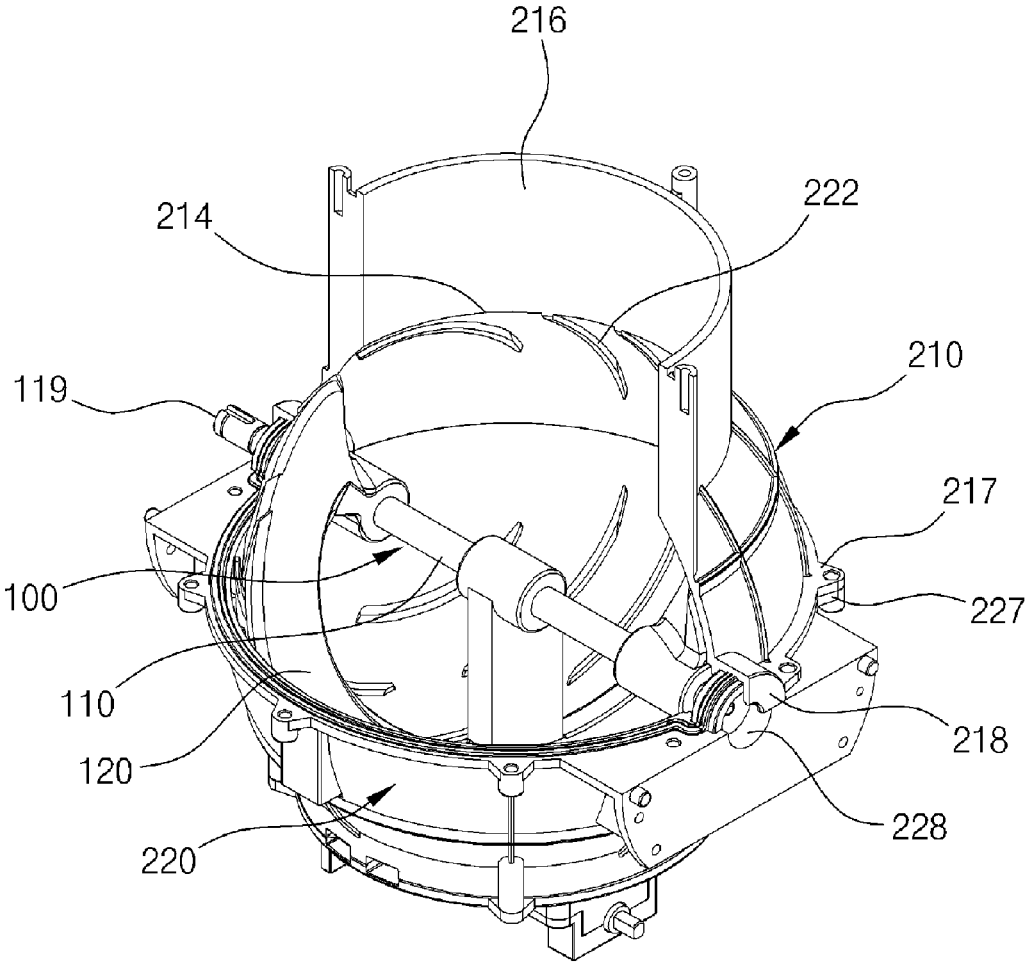
FIG. 1 is a partially broken perspective view of a pulverizer for a food waste treatment apparatus, according to a first embodiment of the present invention.
Figure 2:
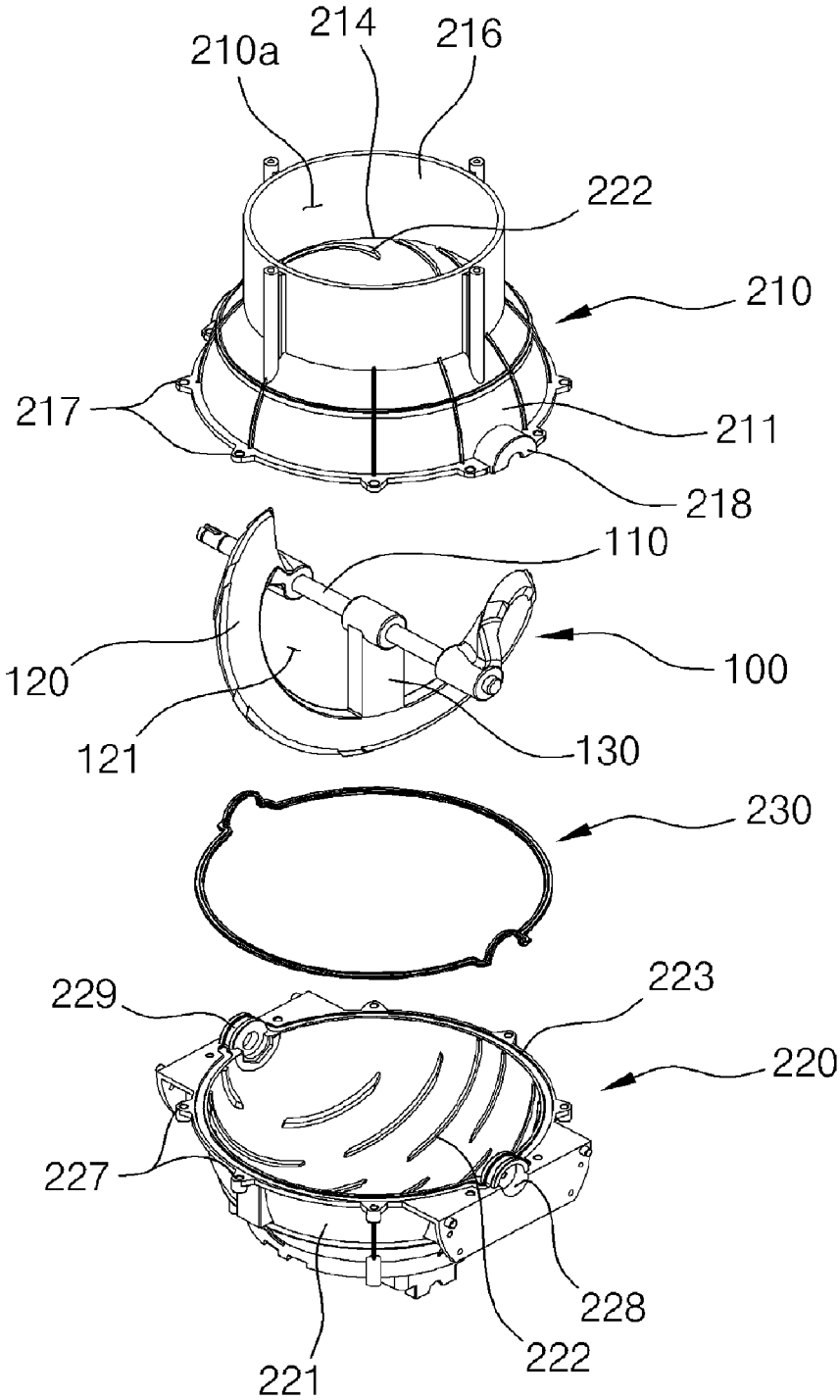
FIG. 2 is an exploded perspective view of the pulverizer of FIG. 1.
Figure 3:
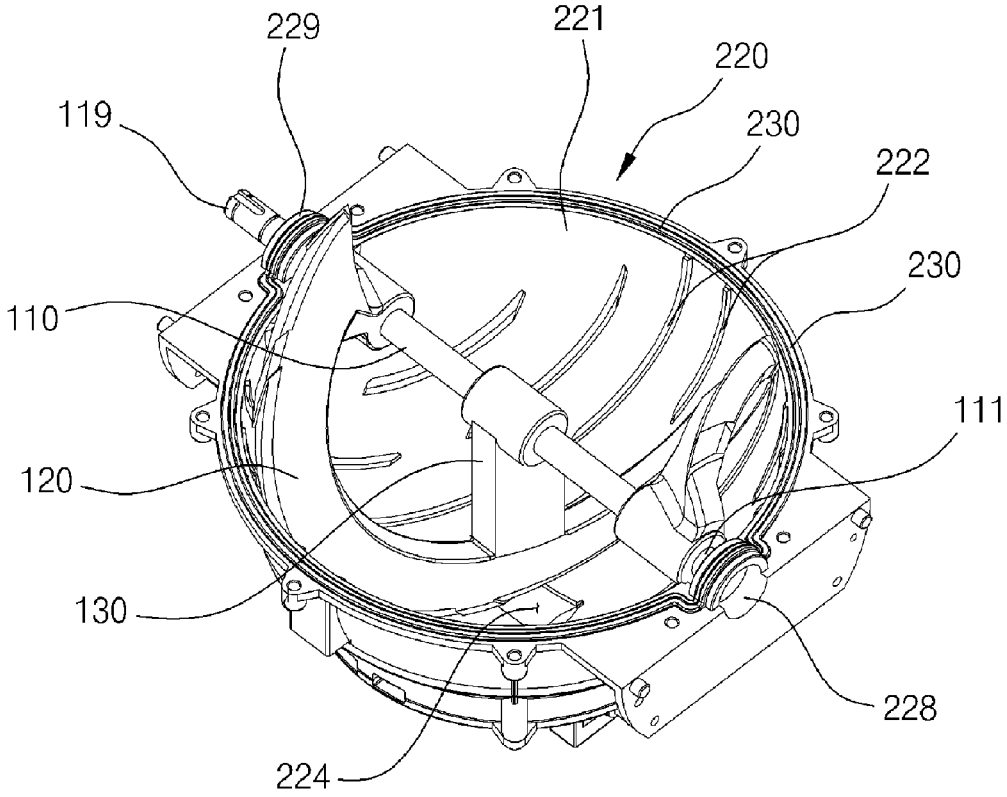
FIG. 3 is a perspective view of the pulverizer of FIG. 1 from which an upper pulverizing casing was removed.

FIG. 1 is a partially broken perspective view of a pulverizer for food waste treatment apparatuses, according to the first embodiment of the present invention. FIG. 2 is an exploded perspective view of the pulverizer of FIG. 1. FIG. 3 is a perspective view of the pulverizer of FIG. 1 from which an upper pulverizing casing 210 was removed.

Referring to FIGS. 1 through 3, the pulverizer for food waste treatment apparatuses according to the first embodiment of the present invention includes a pulverizing casing 200 having a hollow structure, and a pulverizing screw 100 which is installed in the pulverizing casing 200 so as to be rotatable.

In the pulverizer for food waste treatment apparatuses according to the present invention, the pulverizing screw 100 pulverizes food waste input into the pulverizing casing 200. A drying heater may be provided on the circumferential outer surface or the upper end of the pulverizing casing 200 to dry food waste while it is being pulverized.

The pulverizing casing 200 is a hollow unit which has an internal space of predetermined volume so as to contain a predetermined amount of food waste input thereinto. Preferably, the pulverizing casing 200 has a spherical shape. The pulverizing casing 200 is divided into the upper pulverizing casing 210 and a lower pulverizing casing 220 to facilitate the installation of the pulverizing screw 100. Furthermore, it is preferable that the upper and lower pulverizing casings 210 and 220 be manufactured in hemispherical shapes for convenience of manufacture. Typically, they can be formed by molding to ensure the solidity.

The upper pulverizing casing 210 includes an upper body 211 having a hemispheric shape, and a hollow cylindrical input port 216 which extends a predetermined length upwards from the upper end of the upper body 211. Furthermore, a circumferential bent portion 214 is formed by the junction between the input port 216 and the upper body 211. The bent portion 214, along with a drive blade 120, functions to cut food waste in such a way that the drive blade 120 crosses over the bent portion 214 in a state of being spaced apart from the bent portion 214 by a predetermined distance.

The lower pulverizing casing 220 comprises a lower body 221 having a hemispheric shape. A circular seating depression 223 is formed in the surface of the junction of the lower pulverizing casing 220 with the upper pulverizing casing 210. A packing 230 is inserted into the seating depression 223. The packing 230 functions to seal the upper and lower pulverizing casings 210 and 220 after they are assembled with each other, thus preventing food waste from leaking from the pulverizing casing 200.

On the junction between the upper and lower pulverizing casings 210 and 220, first fastening parts 217 are provided around the circumference of the upper pulverizing casing 210 at positions spaced apart from each other at regular intervals, and second fastening parts 227 are provided around the circumference of the lower pulverizing casing 220 at positions spaced apart from each other at regular intervals. To couple the upper and lower pulverizing casings 210 and 220 to each other, coupling bolts (not shown) are tightened into the fastening parts 217 and 227.

Meanwhile, an inlet 210a is formed in the upper end of the outer surface of the upper pulverizing casing 210. As necessary, an outlet 224 may be formed in the lower portion of the outer surface of the lower pulverizing casing 220. The outlet 224 may be configured so as to be openable using a door (not shown). In this case, the door may be electrically operated.

To enable a user to easily input dehydrated and cut food waste into the pulverizing casing 200, the inlet 210a has an appropriate size and is formed in the upper end of the pulverizing casing 200 which is parallel to the support surface. Pulverizing ribs 222 protrude inwards from the circumferential inner surface of the pulverizing casing 200. The pulverizing ribs 222 function to pulverize food waste together with the pulverizing screw 100. The pulverizing ribs 222 are evenly distributed on the inner surfaces of the upper and lower pulverizing casings 210 and 220. Each pulverizing rib 222 may have a plate shape which has a predetermined thickness and sharp edges. The shape of the pulverizing rib 222 is not limited to the above-mentioned shape but may adopt other structures.

Preferably, the pulverizing casing 200 is made of metal which has a relatively high heat transfer rate and is manufactured by molding. Typically, stainless steel can be used as the material of the pulverizing casing 200. More preferably, the pulverizing casing 200 may be coated with molybdenum to prevent remnants of food waste from getting stuck to the surface thereof. Molybdenum is used in anodes, as a grid or a support of an electron tube, a contact point of an electric circuit, a high-temperature resistance portion of a heat-resistance substance, a special alloy, a heating wire, coating material, etc. Molybdenum is mechanically very strong under conditions of very low or high temperature as well as at room temperature, and the use of molybdenum as a material applied to stainless steel is increasing lately.

Here, of course, the material applied to the pulverizing casing 200 is not limited to molybdenum. That is, the pulverizing casing 200 can be coated with any material, so long as it can prevent remnants of food waste from sticking to the surface of the pulverizing casing 200. Furthermore, the pulverizing screw 100 is also coated with molybdenum such that remnants of food waste are prevented from being stuck thereto. Therefore, the treatment operation of the pulverizer can be more reliably conducted.

Figure 4:
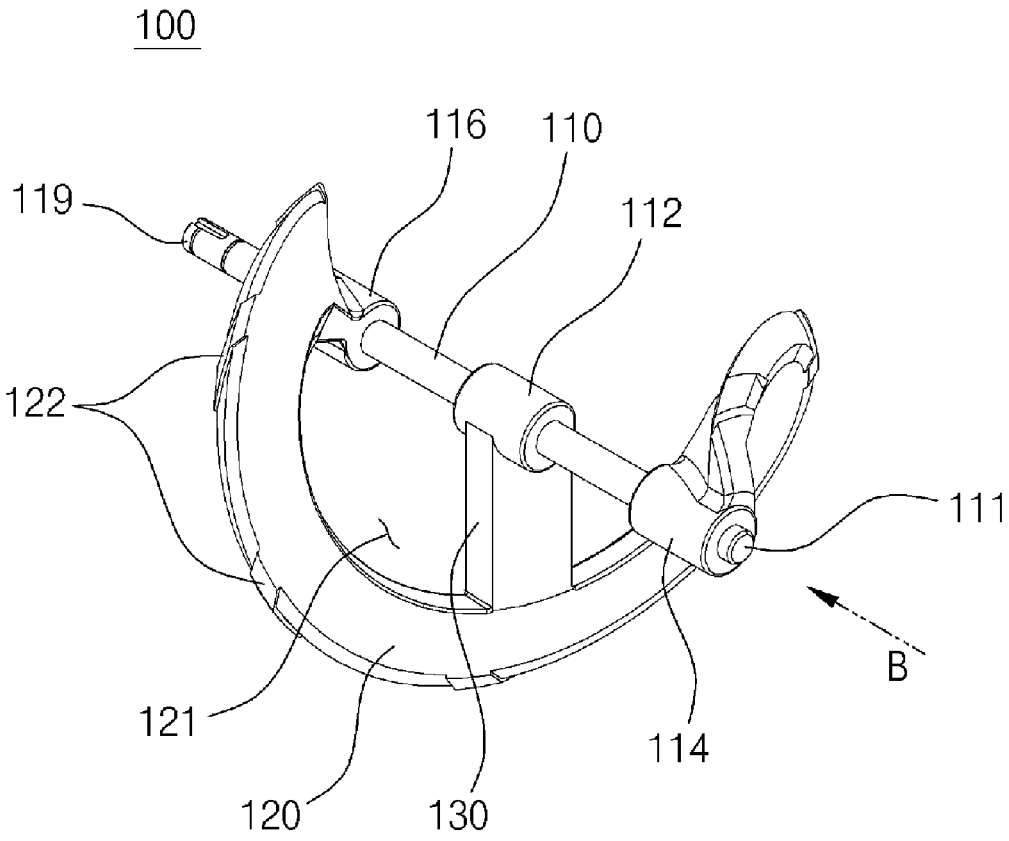
FIG. 4 is a perspective view illustrating a pulverizing screw according to the first embodiment of the present invention.
Figure 5:
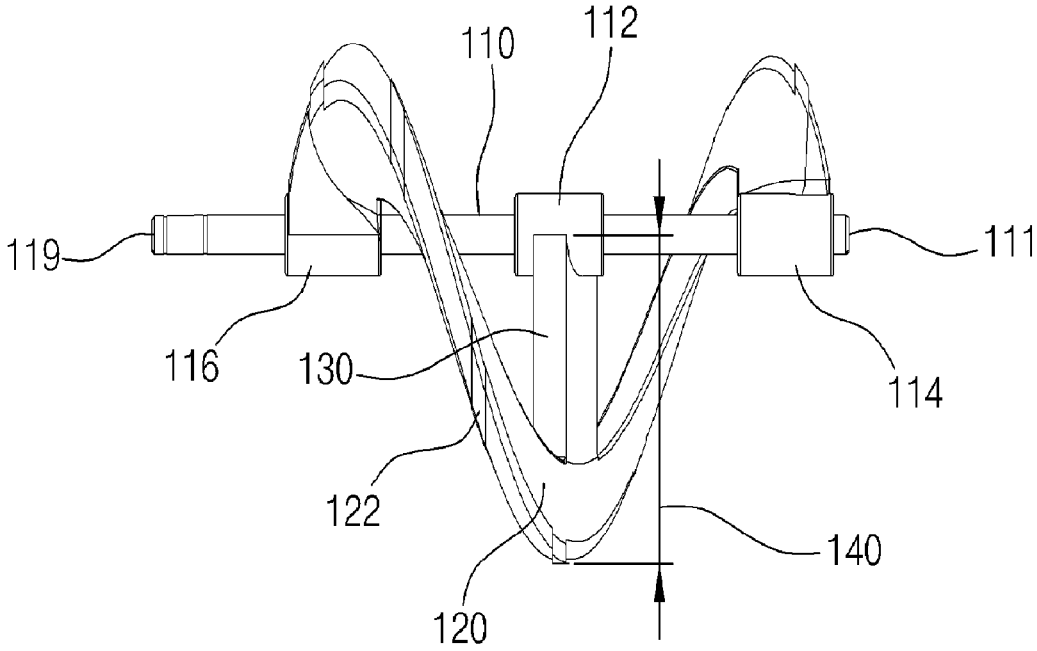
FIG. 5 is a front view of FIG. 4 seen along the A axis.
Figure 6:
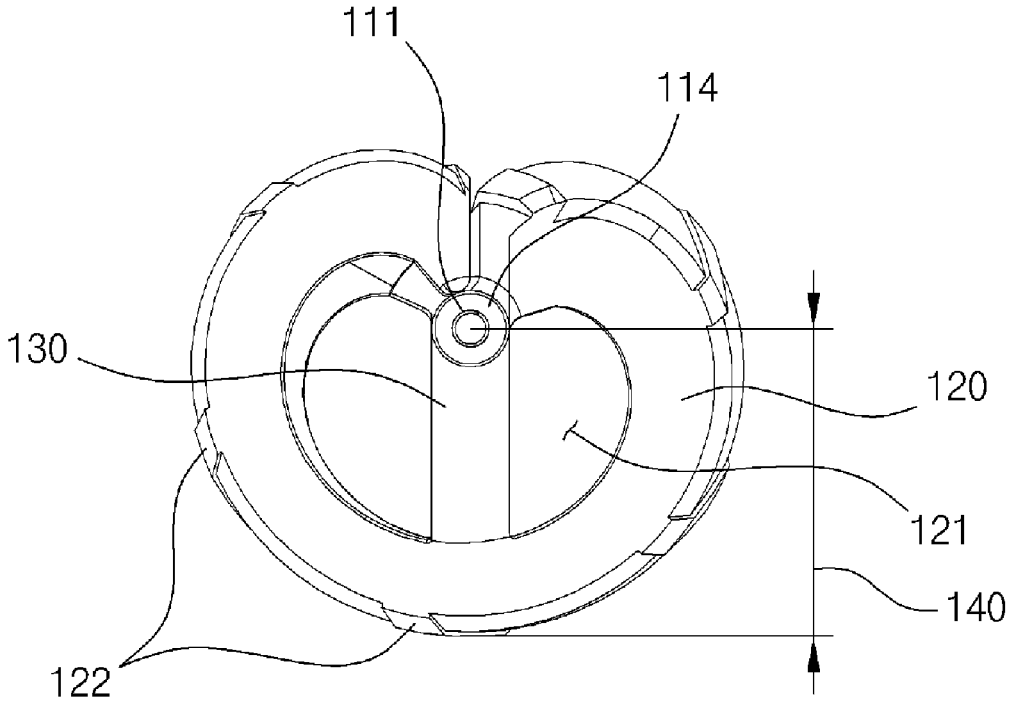
FIG. 6 is a right side view of FIG. 4 seen along the B axis.

FIG. 4 is a perspective view illustrating the pulverizing screw 100 according to the first embodiment of the present invention. FIG. 5 is a front view of FIG. 4 seen along the A axis. FIG. 6 is a right side view of FIG. 4 seen along the B axis.

Hereinafter, the pulverizing screw 100 which is the critical part of the present invention will be described in detail with reference to FIGS. 4 through 6.

The pulverizing screw 100 includes a rotating shaft 110 and at least one drive blade 120 which extends from the rotating shaft 110 in a spiral shape. The drive blade 120 rotates in the spherical pulverizing casing 200 in such a manner as to maintain a state of being spaced apart from the inner surface of the pulverizing casing 200 by a predetermined distance to prevent the drive blade 120 from being impeded by the pulverizing casing 200. In detail, the drive blade 120 extends from a circumferential outer surface of a first end of the rotating shaft 110 in a shape surrounding the rotating shaft 110 in a clockwise or counterclockwise direction and is connected to a circumferential outer surface of a second end of the rotating shaft 110. In the embodiment, the drive blade 120 surrounds the rotating shaft 110 in a spiral shape at an angle of 360°. In the installation of the drive blade 120, a space 121 is defined between the rotating shaft 110 and the drive blade 120.

Cylindrical rotating bodies 112, 114 and 116 are fitted over the circumferential outer surface of the rotating shaft 110. The medial rotating body 112 is disposed at the medial position of the rotating shaft 110. The first side rotating body 114 and the second side rotating body 116 are respectively disposed at the first and second ends 111 and 119 of the rotating shaft 110. A hole is formed through each of the rotating bodies 112, 114 and 116 along a longitudinal central axis thereof, so that the rotating shaft 110 is inserted into the holes of the rotating bodies 112, 114 and 116.

The drive blade 120 extends from the outer surface of the first side rotating body 114 to the outer surface of the second side rotating body 116. In other words, the drive blade 120 is configured such that it is continuous from the outer surface of the first end of the rotating shaft 110 to the outer surface of the second end thereof. A support bar 130 extends from the medial rotating body 112 in the radial direction of the rotating shaft 110. The support bar 130 functions to stably support the drive blade 120 on the rotating shaft 110. That is, the support bar 130 is provided on the medial portion of the rotating shaft 110 and serves to support the entire pulverizing screw 100.

The rotating shaft 110 and the rotating bodies 112, 114 and 116 may be integrally formed into a single body or, alternatively, they may be manufactured through separate processes and assembled to each other so as to be separable. In the case of the integrated structure, they may be formed by molding. In the separable structure, the production cost is reduced, and even if a part is damaged, it can be easily replaced with a new one. In addition, the drive blade 120 and the support bar 130 may be also integrally formed with the rotating bodies 112, 114 and 116 or, alternatively, they may be manufactured through separate processes and be separably assembled to each other. In the same manner, in the integrated structure, they may be formed by molding.

Cutting pieces 122 are provided on an outer cutting edge of the drive blade 120. Each cutting piece 122 has a predetermined thickness and extends a predetermined length in the radial direction of the rotating shaft 110. The cutting pieces 122 serve to evenly pulverize food waste together with the inner surface of the pulverizing casing 200.

Figure 7:
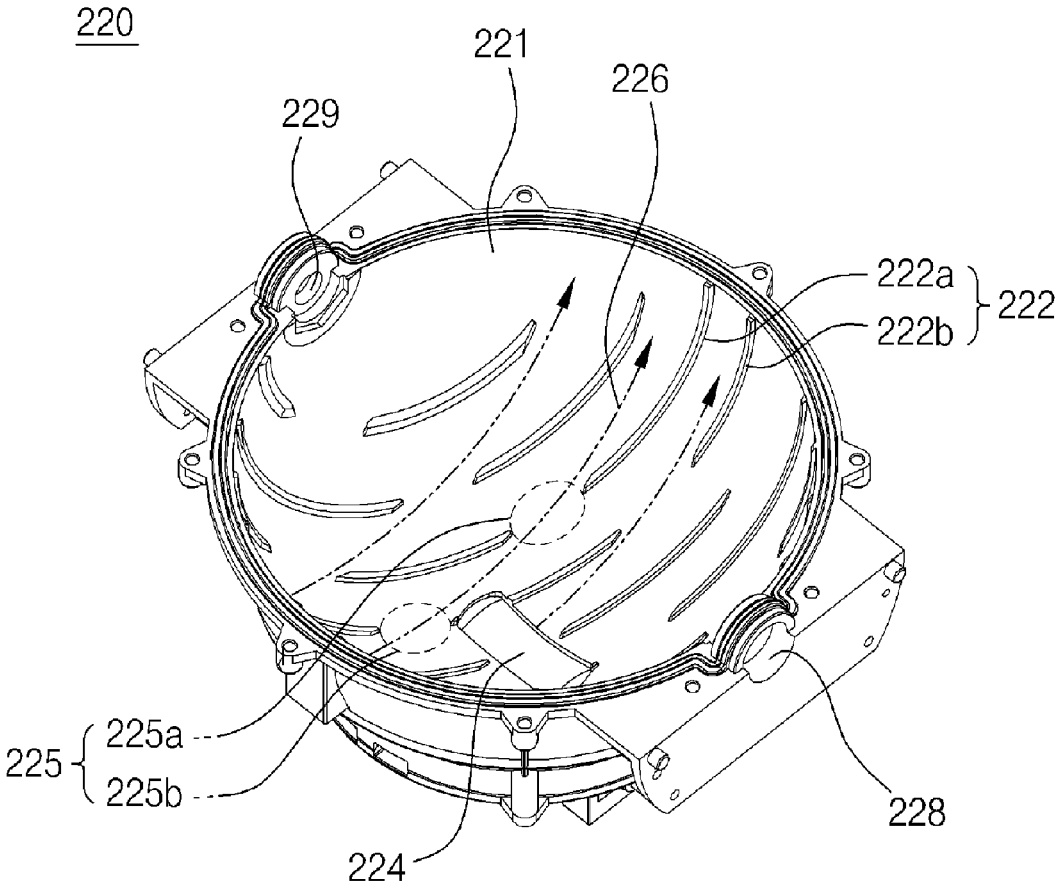
FIG. 7 is a perspective view of a lower pulverizing casing which illustrates the internal construction of the pulverizer according to the present invention.

FIG. 7 is a perspective view of the lower pulverizing casing 220 illustrating the internal construction of the pulverizer according to the present invention. Hereinafter, the relationship between the drive blade 120 and the inner surface of the pulverizing casing 200 will be explained with reference to FIGS. 5 through 7.

Referring to FIG. 7, the pulverizing ribs 222 are provided on the inner surface of the lower pulverizing casing 220. Preferably, the pulverizing ribs 222 protrude inwards from the inner surface of the lower pulverizing casing 220 and are spaced apart from each other at regular intervals.

Two adjacent pulverizing ribs 222*a* and 222*b* will be explained as an example. A first depression 225*a* extending a predetermined distance is formed in the first pulverizing rib 222*a*. A second depression 225*b* extending a predetermined distance is formed in the second pulverizing rib 222*b*. Preferably, several depressions 225*a*, 225*b* are formed in each pulverizing rib 222*a*, 222*b*. As shown by the reference numeral 226, an imaginary line connecting the centers of the depressions 225*a* and 225*b* to each other forms an arc line on the circumferential inner surface of the lower body in the direction angled to the pulverizing ribs 222*a* and 222*b*. That is, as can be understood from the imaginary line 226, the first depressions 225*a* and the second depressions 225*b* are located at positions misaligned from each other.

When the pulverizing screw 100 rotates in the pulverizing casing 200, the cutting pieces 122 of the drive blade 120 conduct circular orbital motion along the imaginary lines 226.

In this process, the cutting pieces 122 scrape remnants of food waste off between the pulverizing ribs 222 while the pulverizer is in operation. Furthermore, the drying operation can also be conducted while pulverizing food waste. Thus, because the cutting pieces 122 scrape food waste while or after the food waste is dried, the food waste which has been stuck to the inner surface of the pulverizing casing 200 can more easily and reliably removed therefrom.

The cutting pieces 122 must maintain the state of being spaced apart from the pulverizing ribs 222 by predetermined distances to avoid interference therebetween. While the drive blade 120 rotates, the outer cutting edge and cutting pieces 122 of the drive blade 120 cross over the inner surface of the pulverizing casing 200, thus pulverizing food waste.

As shown in FIGS. 5 and 6, the medial portion of the drive blade 120 is farther from the rotating shaft 110 than are other portions. In other words, with regard to the shape in which the drive blade 120 extends from the rotating shaft 110 in a spiral shape, the distance between the drive blade 120 and the rotating shaft 110 is increased from the first end of the drive blade 120 to the medial portion thereof, and the distance therebetween is reduced again from the medial portion of the drive blade 120 to the second end thereof. In the drawing, the reference numeral 140 denotes the distance from the central axis of the rotating shaft 110 to the medial portion of the drive blade 120.

Due to the structural characteristics of the pulverizing screw 100, when the pulverizing screw 100 rotates, the medial portion of the drive blade 120 holds and lifts food waste which is at the lowermost position in the lower body 221. As such, in the process of treating food waste, food waste which is gathered on the lower portion in the pulverizing casing 200 can be continuously moved upwards by the pulverizing screw 100, thus being evenly agitated. Therefore, the pulverization and agitation of food waste in the pulverizing casing 200 can be smoothly and reliably conducted. Furthermore, because the space 121 is defined between the drive blade 120 and the rotating shaft 110, when the drive blade 120 holds and lifts food waste, food waste over a proper amount naturally falls onto the lower portion of the lower body 221 through the space 121. Thereby, overload is prevented from being applied to a power supply means (not shown) for driving the drive blade 120.

Meanwhile, to install the pulverizing screw 100 in the lower pulverizing casing 220, a first support mount 228 is provided on the lower pulverizing casing 220 at a first end of the junction surface thereof with the upper pulverizing casing 210, and a second support mount 229 is provided on the lower pulverizing casing 220 at a second end of the junction surface. The first end 111 and the second end 119 of the rotating shaft 110 are respectively inserted so as to be rotatable into insert holes formed in the first and second support mounts 228 and 229. A bearing may be provided in each insert hole of the first and second support mounts 228 and 229 to ensure smooth rotation. In addition, the power supply means (not shown), such as a motor, is connected to the second end 119 of the rotating shaft 110 to supply power thereto.

The rotating shaft 110 receives power from the power supply means (not shown) and transmits the rotating force to the drive blade 120 such that the pulverizing screw 100 is able to rotate in the pulverizing casing 200.

Figure 8:
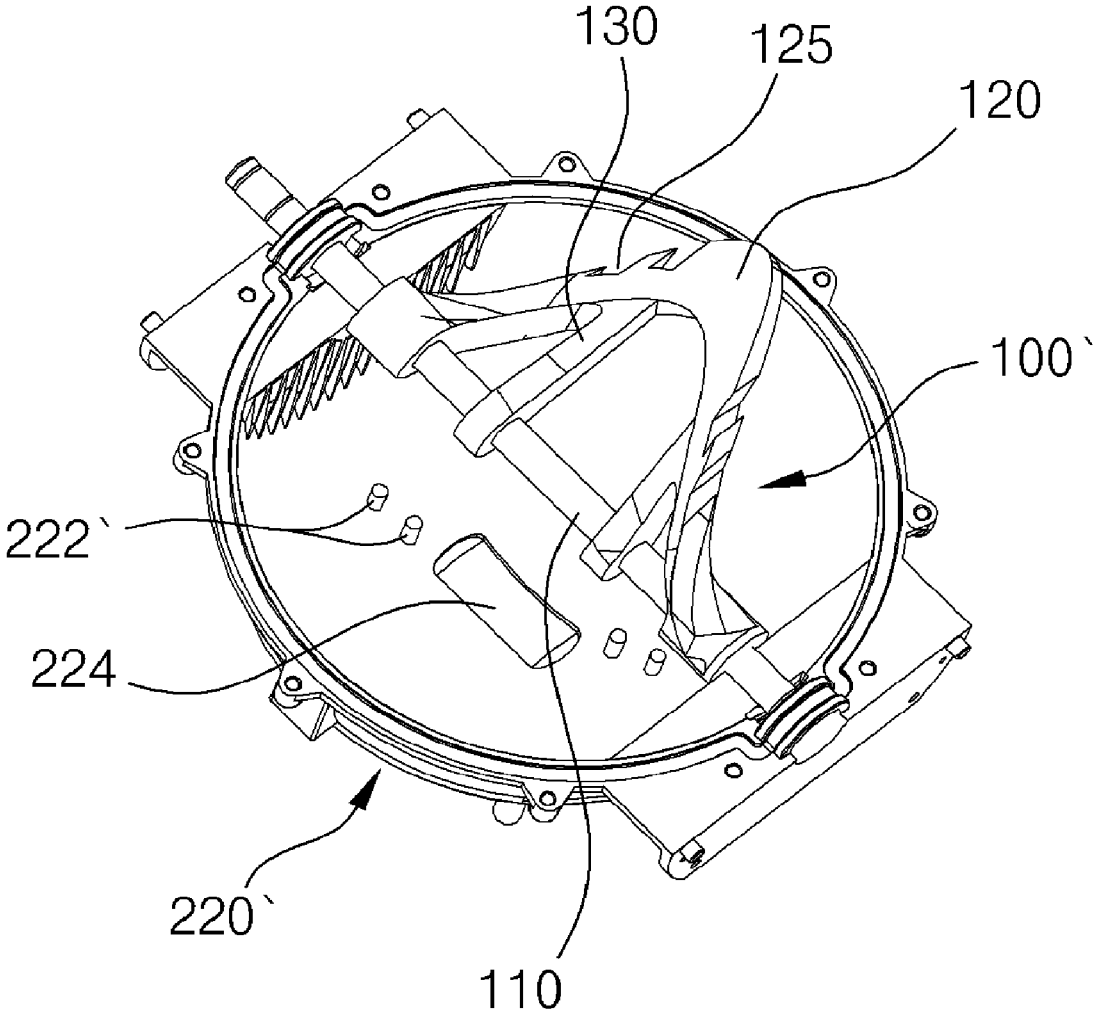
FIG. 8 is a perspective view of a pulverizing screw and a lower pulverizing casing of a pulverizer, according to a second embodiment of the present invention.

FIG. 8 is a perspective view of a pulverizing screw 100' and a lower pulverizing casing 220' of a pulverizer, according to a second embodiment of the present invention. Hereinafter, the pulverizing screw 100' and the lower pulverizing casing 220' according to the second embodiment will be described in detail with reference to FIG. 8.

In the second embodiment, cutting notches 125 having predetermined depths are formed in an outer cutting edge of a drive blade 120 constituting the pulverizing screw 100'. The shape of each cutting notch 125 is determined along a circumference of an imaginary circle which is defined around the central axis of a rotating shaft 110 and has a predetermined radius. In other words, according to the intended purposes of a designer, various numbers of cutting notches 125 may be formed in the drive blade 120 along the circumferences of imaginary concentric circles which are formed around the central axis of the rotating shaft 110 and have different radii.

Pulverizing protrusions 222' corresponding to the cutting notches 125 of the drive blade 120 are provided on the circumferential inner surface of the lower pulverizing casing 220'. The pulverizing protrusions 222' are provided on at least one concentric circle at positions spaced apart from each other at regular or irregular intervals.

When the pulverizing screw 100' rotates in the pulverizing casing 200, the pulverizing protrusions 222' pass through the cutting notches 125. As such, because the pulverizing protrusions 222' are on the moving track of the cutting notches 125, food waste which is held by the cutting notches 125 can be reliably pulverized by the rotation of the pulverizing screw 100'. Preferably, cutting edges may be formed on the inner surface of the cutting notches 125.

As described above, in the pulverizer for food waste treatment apparatuses according to the present invention, a pulverizing screw having a spiral blade is installed in a spherical pulverizing casing, so that food waste input into the pulverizer can be evenly distributed and pulverized, thus enhancing the operational efficiency of the pulverizer, and reducing power consumption.

Furthermore, the present invention provides a functional combination type pulverizer which takes advantage of the vertical type pulverizer and the horizontal type pulverizer, thus solving the problems of the conventional pulverizers. In other words, the present invention can minimize the problems of remnants of food waste being stuck to the inner surface of the pulverizer or some of the food waste remaining in the pulverizer after the food waste is discharged therefrom, which are problems which commonly result from using the conventional vertical type pulverizer and the conventional horizontal type pulverizer.

In brief, the present invention can optimize the efficiency with which food waste is agitated, pulverized and carried. In addition, a load applied to the pulverizing screw can be reduced, thus enhancing the durability thereof. As well, remnants of food waste which are present in the pulverizer can be minimized. Therefore, the present invention can meet the needs of consumers.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. Furthermore, these modifications, additions and substitutions should be regarded as falling within the bounds of the present invention.

What is claimed:

1. A pulverizing casing assembly of a food waste treatment apparatus having a pulverizing casing and a pulverizing screw provided in the pulverizing casing so as to be rotatable, the food waste treatment apparatus pulverizing, agitating and drying food waste input into the pulverizing casing, wherein the pulverizing screw rotates in the pulverizing casing in such a manner as to maintain a predetermined distance between the pulverizing screw and an inner surface of the pulverizing casing to prevent the pulverizing screw from being impeded by the inner surface of the pulverizing casing, and the pulverizing casing comprises a spherical body having a hollow space therein, wherein pulverizing ribs which are provided on a circumferential inner surface of the spherical body are spaced apart from each other, and each of the pulverizing ribs has depressions therein, wherein an imaginary line connecting the depression of the pulverizing ribs to each other forms an arc line of the circumferential inner surface of the spherical body in a direction making an angle with the pulverizing ribs.

2. The pulverizing casing assembly as set forth in claim 1, wherein one or more pulverizing ribs forming a protrusion shape are provided on a circumferential inner surface of the spherical body.

3. The pulverizing casing assembly as set forth in any one of claims 1 and 2, wherein a hollow cylindrical input port extends from an upper portion of the spherical body, the input port being formed to parallel a support surface.

* * * * *